United States Patent [19]

Vogel

[11] Patent Number: 4,781,309

[45] Date of Patent: Nov. 1, 1988

[54] DISPENSER WITH IMPROVED CARBONATED WATER MANIFOLD

[75] Inventor: James D. Vogel, Anoka, Minn.

[73] Assignee: The Cornelius Company, Anoka, Minn.

[21] Appl. No.: 16,604

[22] Filed: Feb. 19, 1987

[51] Int. Cl.[4] ..... B67D 5/56; B67D 5/62

[52] U.S. Cl. ..... 222/129.1; 137/561 A; 62/390; 62/396; 222/146.6

[58] Field of Search ..... 222/129.1–129.4, 222/144.5, 145, 146.6; 137/561 A; 62/390, 391, 393–396, 398–400

[56] References Cited

U.S. PATENT DOCUMENTS

| | | | |
|---|---|---|---|
| 2,327,910 | 8/1943 | Levine | 222/146.6 X |
| 3,175,578 | 3/1965 | Patterson et al. | 137/561 A |
| 3,209,952 | 10/1965 | Cornelius | 222/146.6 X |
| 3,224,641 | 12/1965 | Morgan | 222/146.6 X |
| 3,240,395 | 3/1966 | Carver | 222/129.1 |
| 3,348,737 | 10/1967 | Yingst et al. | 222/129.1 X |
| 3,422,634 | 1/1969 | Brown | 62/390 |
| 3,799,196 | 3/1974 | Scheitlin et al. | 137/561 A |
| 3,892,335 | 7/1975 | Schroeder | 222/146.6 X |
| 4,615,466 | 10/1986 | Credle, Jr. | 222/146.6 X |
| 4,651,538 | 3/1987 | Bull et al. | 222/146.6 |

*Primary Examiner*—Kevin P. Shaver
*Attorney, Agent, or Firm*—Henry C. Kovar

[57] ABSTRACT

A carbonated beverage dispenser has an improved carbonated water distribution manifold for evenly and reliably distributing carbonated water from a single carbonator and cooling structure to a plurality of post-mix dispensing valves without decarbonation, flow restriction, foaming or other deficiencies. The improved carbonated water distribution manifold is fabricated of stainless steel and has a tubular inlet fitting, a plurality of tubular outlet fittings, a distribution plenum in between the inlet and outlet fittings with the plenum having a generally planar inlet wall into which the inlet fitting extends, a generally planar outlet wall into which the outlet fittings individually extend, additional plenum walls adjoining the inlet and outlet walls and jointly forming the plenum with there being an interior carbonated water distribution chamber inside the plenum, and in which all of the inlet and outlet fittings are welded to the inlet and outlet walls respectively from inside of the distribution chamber.

11 Claims, 2 Drawing Sheets

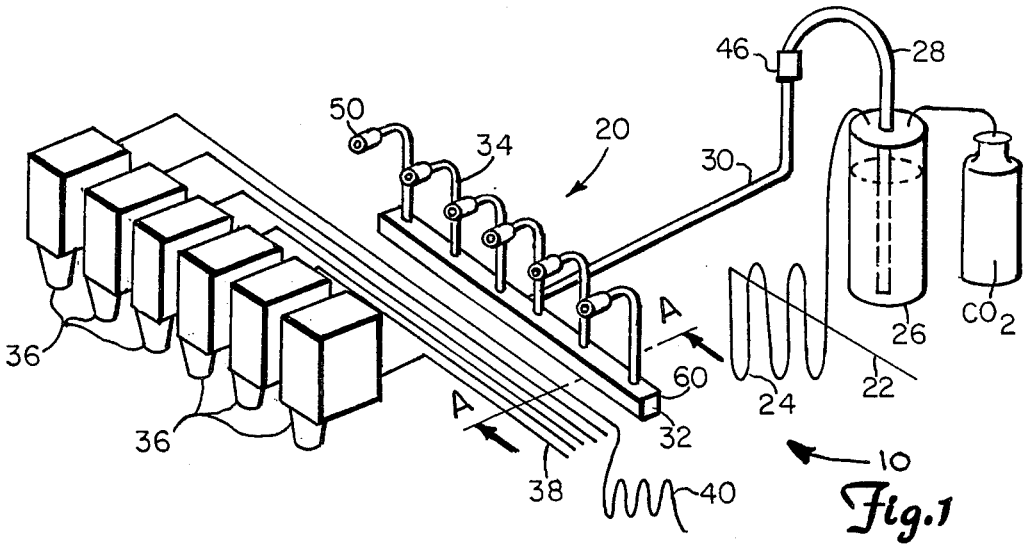
Fig.1
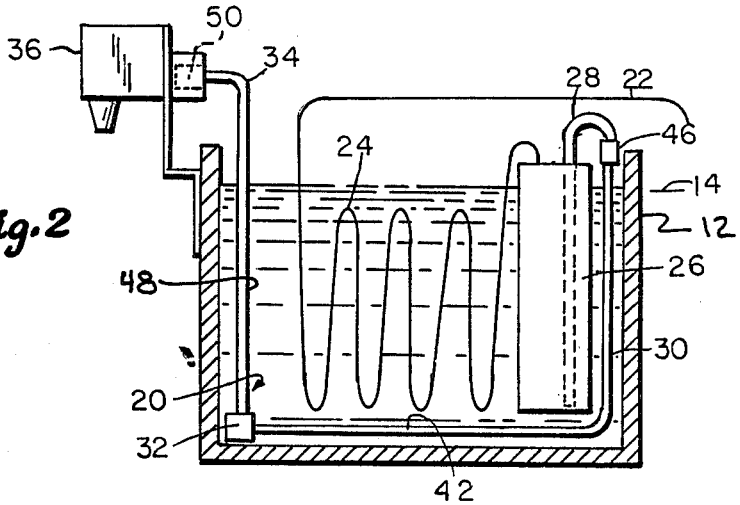
Fig.2
Fig.3
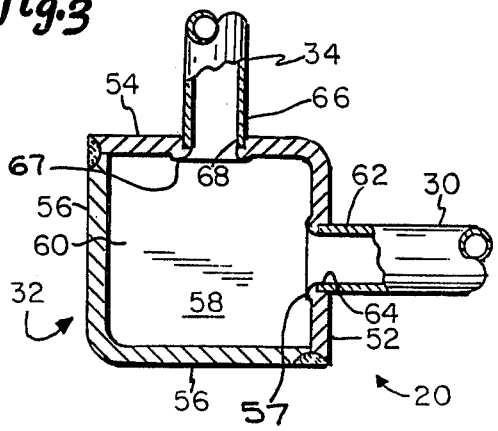
Fig.4
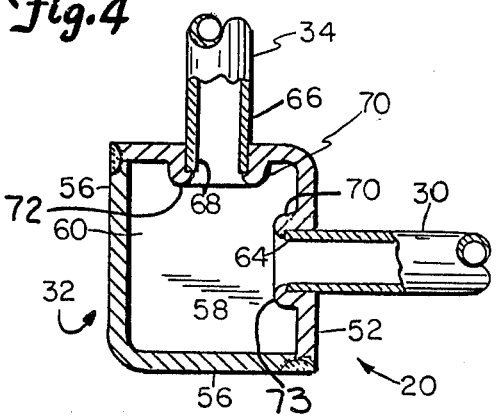

Fig.5a
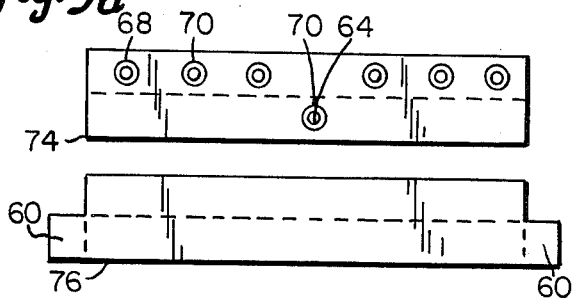
Fig.5b
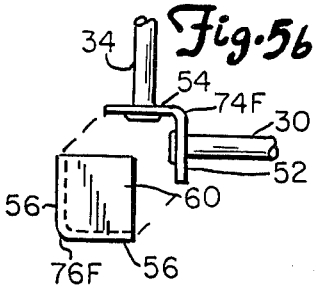
PRIOR ART
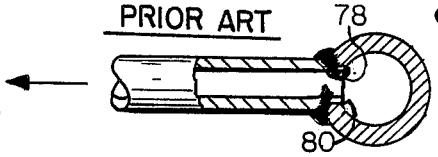
Fig.6
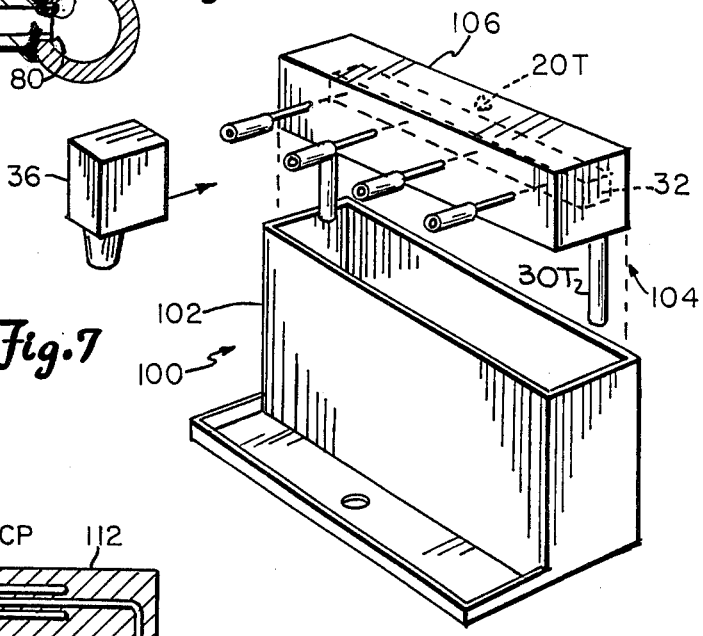
Fig.7
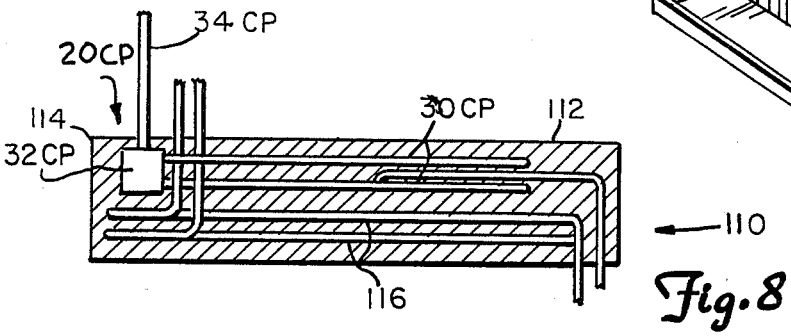
Fig.8
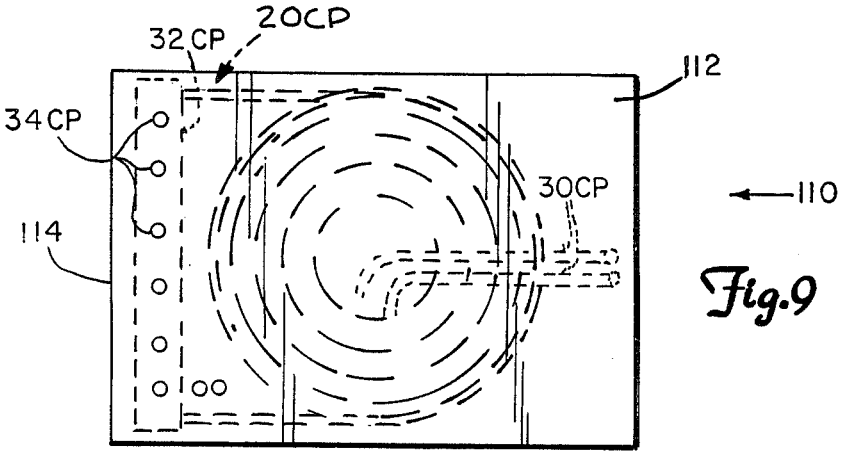
Fig.9

DISPENSER WITH IMPROVED CARBONATED WATER MANIFOLD

BACKGROUND OF THE INVENTION

1. Field of the Invention

This invention pertains to a carbonated water dispenser having an improved carbonated water distribution manifold connected to several post-mix dispensing valves, to an improved carbonated water distribution manifold, and to a method of making an improved carbonated water distribution manifold.

2. The Prior Art

A post-mix carbonated beverage dispensing system makes its own carbonated water from a supply of municipal or well water, and then distributes the carbonated water to a plurality of post-mix valves. Each post-mix valve mixes carbonated water with syrup and effects dispensing of a complete beverage. These dispensers are typically found in fast food retailers, theatres, convention centers, sports facilitates and the like, and are most often used to fill cups with beverage.

Most of all these plural flavor post-mix dispensers have some type of structure to distribute carbonated water from a single or plural carbonator to a plurality of dispensing valves. There typically will be a minimum of four dispensing valves and it is common to see up to eight dispensing valves being supplied from a single carbonator.

The structure that distributes the carbonated water has been a continual source of problems and a cause of decarbonation and foaming during dispensing. One structure for distributing carbonated water was a molded plastic housing with metal ferrules for an inlet and plural outlets.

These devices had to be located remote from the cooling structure and during stand by time, carbonated water in the housing would warm up and decarbonate. Leakage, ferrule breakage, stress cracks and sanitation were also continually reoccurring problems.

A metal block with a bored out center section, with bored and tapped transverse aperture with adapter fittings has also been used. These are expensive, heavy, bulky, leaky, very difficult to sanitize and are not an effective solution.

The most recently commercially used structure for distributing carbonated water is a manifold made of a elongate length of stainless steel tubing forming an elongate plenum.

At least one end of the tube is closed and the other end may be an inlet or may be closed. Several transverse fittings are welded into apertures drilled transversely into the plenum tube. The transverse fittings are then welded into the plenum tube. This structure has been in use for several years and is the least costly, and most structurally efficient known device for distributing carbonated water in a dispenser.

The problem is that it may or may not properly dispense carbonated water and beverage; you really don't know until the dispenser has been in use for a period of time. The problem results from the welding of the transverse fittings to the plenum tube. The weld usually breaks through at least one of the transverse tubes and causes an obstruction in the tube. Carbonated water flowing over the obstruction then decarbonates and the dispensing valve foams. A given manifold may have five good outlets and one bad outlet; it may have three bad outlets, it may have a bad inlet, it may be perfectly good. Whether the manifold is a good one or a defective one can't be visually determined. Consequently the quality control and quality repeatability of these manifolds is very poor. These manifolds are also a sanitary problem because of crevices in the weld, and/or crevices where the weld has not completely penetrated. The welds in this manifold cannot be viably inspected from the inside. The retailer or beverage entity that ends up with a defective manifold has to go through all kinds of exercise to determine the manifold is defective. Usually dispensing valves will be changed, sanitizing will be done, and a serviceman will attempt to adjust the dispenser.

This is a serious irritant and quality problem for the food and beverage industry. Carbonated water is a very unique and delicate substance to handle, convey and distribute, while preventing decarbonation and resultant foaming of beverage.

The existing manifolds are not good enough to be cast into aluminum cold plates for ice cooled dispensers because of poor welds, cracking, leaking, and the poor quality previously referred to may lead to the loss of a quite valuable casting because of a defective weld.

OBJECTS OF THE INVENTION

It is an object of the present invention to provide an improved cold carbonated beverage dispenser having consistent delivery of highly carbonated water equally to all dispensing valves with a predictable, constant and repeatable level of quality, and a multiple flavor post-mix dispenser which dispenses post-mix carbonated beverage without foaming decarbonation or bubbling from any one or more of the dispensing heads.

It is an object of the present invention to provide an improved carbonated water distribution manifold that is welded from the inside and which will predictably and consistently deliver carbonated water without decarbonation or pressure drop to each and every dispensing valve.

It is an object of the present invention to provide a method of making an improved carbonated water distribution manifold wherein unpredictable welding obstructions and crevices which cause pressure drop, decarbonation, obstructed flow, and sanitation problems are eliminated.

It is an object of the present invention to provide a dispensing tower having a manifold pack with an improved carbonated water distrubtion manifold.

It is an object of the present invention to provide a cold plate for an ice cooled beverage dispenser wherein the cold plate has an improved cast-in carbonated water distribution manifold.

SUMMARY OF THE INVENTION

According to the principles of the present invention, an improved cold carbonated beverage dispenser has a carbonator, a plurality of post-mix beverage dispensing heads each of which is connectible to the carbnator, and a carbonated water distribution manifold fluidly between the carbonator and the dispensing heads; the manifold has a tubular inlet fitting, tubular outlet fittings, a carbonated water distribution plenum between the inlet and outlet fittings, a planar inlet wall with the inlet fitting being welded to the inlet wall from inside the plenum, and planar outlet wall with the outlet fittings being welded to the outlet wall from inside the plenum; this manifold assures delivery of carbonated water without decarbonation equally to each and every dispensing head on the dispenser.

An improved carbonated water distribution manifold has a tubular inlet fitting, a plurality of discrete tubular outlet fittings, and a distribution plenum between the inlet and outlet fittings, the plenum has an inlet wall with an aperture into which the inlet fitting extends, an outlet wall with a plurality of outlet apertures into which the outlet fittings extend, and additional plenum walls welded to the inlet and outlet walls, with the inlet and outlet fittings being welded from inside of the plenum chamber, with there being no weld obstructions or crevices to cause decarbonation during flow of carbonated water through the manifold and out any one of the outlet fittings.

A method of making an improved carbonated water distribution manifold has the steps of making an elongate tubular stainless inlet fitting, making a plurality of elongate tubular stainless outlet fittings, making a planar stainless inlet wall, making a planar stainless outlet wall, making additional stainless plenum walls, welding the inlet and outlet fittings to the inlet and outlet walls respectively from a future inside of a carbonated water plenum, and welding the walls together forming the plenum chamber between the inlet and outlet fittings, with all of the fittings being unobstructed by weld and devoid of crevices, so that carbonated water will flow through the manifold and out any outlet fitting without decarbonation or pressure drop, and without sanitation problems.

Many other advantages, features and additional objects of the present invention will become manifest to those versed in the art upon making reference to the detailed description and accompanaying drawings in which the preferred embodiment incorporating the principles of the present invention is set forth and shown by way of illustrative example.

BRIEF DESCRIPTION OF THE DRAWINGS:

FIG. 1 is a perspective view showing schematically the pertinent structure of a an improved beverage dispenser with the present invention therein;

FIG. 2 is a cross-sectional elevational view of the structure of FIG.1;

FIG. 3 is a cross-sectional view taken through lines A—A;

FIG. 4 is an alternative cross-sectional view taken through lines A—A;

FIG. 5*a* and FIG. 5*b* show a detailed view explaining fabrication of the improved manifold of the present invention;

FIG. 6 is a cross sectional view of the prior art;

FIG. 7 is a diagramic view of a beverage dispensing tower having a an improved manifold pack with the improved manifold of the present invention;

FIG. 8 is an elevational cross section of a an improved cold plate having the present invention therein; and FIG. 9 is a plan view of the structure of FIG. 8.

DESCRIPTION OF THE PREFERRED EMBODIMENT

The principles of the present invention are particularly useful when embodied in an improved cold carbonated post-mix beverage dispenser such as is shown schematically in FIGS. 1 & 2 and generally indicated by the numeral 10.

The dispenser 10 has a cooling tank 12 which is filled with ice water to level 14 with the ice water being cooled and having an ice bank of several pounds built therein by an electromechanical refrigeration chassis (not shown) which has an evaporator coil (not shown) normally immersed in the ice water and about which the ice bank reservoir is frozen and held in the water bath.

An important feature of the present invention is the carbonated water distribution manifold shown in FIGS. 1 & 2 and generally indicated by the numeral 20. A water inlet line 22 is connectible to a municipal or other bulk source of palatable sweet water and supplies a water pre-cool coil 24 in the cooling tank 12. The pre-cool coil 24 serves to cool incoming water to close to 32 degrees F. (0 degrees C.) and is connected to supply this cooled water to a carbonator 26. The carbonator is also appropriately connected to a source of carbon dioxide gas (not shown) which effects carbonation of the water in the carbonator 26 to a carbonation level in the range of 4.5 to 5.0 volumes. A carbonated water outlet line 28 extends from the carbonator 26 to an inlet fitting 30 of the carbonated water distribution manifold 20. The inlet fitting 30 leads to a carbonated water distribution plenum 32 which has a plurality of discrete carbonated water outlet fittings 34. Each of the outlet fittings 34 are discretely fluidly connected to the carbonated water inlet of a respective carbonated beverage dispensing head 36. Each dispensing head 36 is for a specific flavor, such as Cola, Diet Cola, Lemon-Lime, Diet Lemon-Lime, Cherry Cola, Orange, and so forth, and a discrete syrup supply line 38 is connected to each dispensing head 36; the syrup supply lines 38 each include a discrete syrup cooling coil 40 which is also immersed in the cooling tank 12.

As shown in FIGS. 1 & 2, the plenum 32 preferably lies on the bottom of the cooling tank 12 along and transversely spanning a front side of the tank. The elongate tubular inlet fitting 30 has a horizontal length 42 extending rearward on the bottom of the tank 12 to an upward extending length 44 leading to an inlet end 46 which is above the water level 14. The elongate tubular outlet fittings 34 each have an upright length 48 which extends upward and out of the water bath to an outlet end 50 which is above the water level 14. Thus the inlet 46 and every outlet 50 is well above the water level 14 enabling easy access, connection, disconnection, sanitation, and minimum probability of contamination.

In FIG. 3, a first preferred cross section and construction of the water manifold 20 is shown. An inlet wall 52 and an outlet wall 54 are formed of a single L-shaped piece. Additional plenum walls 56 are formed and welded to the inlet and outlet walls 52, 54 to form the plenum 32 with an interior carbonated water distribution chamber 58. The ends of the plenum 32 and water chamber 58 are closed by end caps 60. An outlet end 62 of the inlet fitting 30 is inserted into an inlet aperture 64 of the inlet wall 52 and is welded to the inlet wall 52 from inside of the plenum 32.

A convex and smoothly radiused toroidal outlet ring 57 is formed around the outlet end 62 and inside the plenum 32. The outlet ring 57 has a minor diameter with is substantially the same as the inside diameter of the outlet end 62 as shown, and the smooth convex radius of the outlet ring 57 enables smooth carbonated water flow out of the unobstructed inlet fitting 30 and into the water distribution chamber 58. An inlet end 66 of each outlet fitting 34 is inserted into a discrete respective outlet aperture 68 in the outlet wall 54 and each outlet fitting 34 is welded to the outlet wall 54 from inside of the plenum 32.

A convex and smoothly radiused toroidal inlet nose 67 is formed around each inlet end 66 and inside the plenum 32. The inlet nose 67 has a minor diameter which is substantially the same as the inside diameter of the inlet end 66 as shown, and the smooth radiused inlet nose 67 enables smooth carbonated water flow into the unobstructed and bell mouthed inlet end 66 of each outlet fitting 34.

In FIG. 4 the inlet aperture 64 and all outlet apertures 68 are provided with an inwardly formed weld ring 70 that projects inwardly into the plenum 32 and the water distribution chamber 58. The inlet end 66 of each outlet fitting 34 is inserted into and through a respective weld ring 70. The inlet end 66 and weld ring 70 are welded together at their inner ends from inside of the eventual plenum 32 and water distribution chamber 58. A convex smoothly curved and radiused bell-shaped toroidal entry nose 72 is formed by the weldment of the inlet end 66 and weld ring 70 with a minor or smallest diameter of the toroidal inlet nose 72 being substantially the same as the inner diameter of the inlet end 66 as clearly shown. The inlet end 66 and weld ring 70 are welded together at their inner ends from inside of the eventual plenum 32 and water distribution chamber 58. The inlet 66 inner diameter is the diameter of the carbonated water passageway extending through the outlet fitting 34 and there is no obstruction whatsoever to entry of water into each and every outlet fitting 34. The inlet nose 72 provides a relatively gentle and close to laminar inlet flow of carbonated water that does not cause decarbonation or undesirable pressure drop. An outlet ring 73 of FIG. 4 is structurally identical to the inlet nose 72. The material thickness of the weld ring 70 provides the majority of the toroidal inlet nose 72 and outlet ring 73 as clearly shown in FIG. 4.

FIG.5*a* and FIG. 5*b* further illustrate the componentry of the manifold 20 and enable further explanation of the improved method of fabricating this carbonated water distribution manifold 20. The manifold 20 is constructed completely of stainless steel and after completion of fabrication is chemically passivated and pressure tested to a nominal proof pressure well in excess of the 125 PSI maximum working pressure. A first stainless steel sheet metal blank 74 is fabricated having the inlet aperture 64 and outlet apertures 68. The flanged in weld rings 70 are also formed and extend to one side of the blank 74. The blank 74 is formed along its length into an L-shape to define the planar inlet wall 52 and planar outlet wall 54. The inlet fitting 30 is inserted into the inlet aperture 64 and welded to the weld ring 70 or inner surface of the inlet flange 52 from the concave side of the L-shaped blank 74F; this concave side being the future inside of the plenum 32. The outlet fittings 34 are then inserted into respective outlet apertures 68 and are likewise welded to the weld rings 70 or inner surface of the outlet flange 54 from the concave side of the L-shaped blank 74F. The welds of the fittings 30, 34 to the walls 52, 54 are now 100% visually inspected. This inspection can be done easily and without instruments. A completely reliable determinatiton is made that the welds are good and that there is no blockage of the inlet or outlet fittings 30, 34, that the welds are complete and that there are nonsanitary crevices or inclusions. The metal used for the blank 74 is about 0.060 inch (1.5 mm) thick and the tubular fittings 30, 34 have a metal wall section in the range of a 0.020–0.025 inch (0.50–0.60 mm) thick. The inlet and outlet walls 52, 54 are thicker and preferably at least twice as thick as the walls of the fittings 30, 34 which assists in producing high quality welds that do not protrude into the fittings 30,34. The outlet from the inlet fitting 30 and the inlets to the outlet fittings 34 are now nicely rounded surfaces which enhance proper fluid flow through the manifold 20. Upon completion of the welded assembly of the fittings 30,34 and inlet and outlet wall blank 74, the plenum 32 is ready to be completed and closed up. A second wall blank 76 has the additional plenum walls 56 and end caps 60 and is formed into the configuration shown as 76F in FIG. 5*b*. The formed additional wall blank 76F is then placed against and welded to the formed inlet and outlet wall blank 74F to form the completed plenum 32 and manifold 20. The tubular inlets and outlet fittings will typically have 0.250 to 0.312 inch (6–8 mm) inside diameter and the plenum 32 will typically have an internal cross section in the range of 0.5 to 0.75 inches (12.5–19 mm) square or rectangular so that the distribution chamber 58 has a cross section which is always larger than a cross-section of the fittings 30,34. The exterior weld of the plenum wall blanks 74F, 76F is easily repaired if it leaks without effecting the welds of the fittings 30,34 to the inlet and outlet walls 52,54.

This improved method of fabrication and improved manifold 20 enable consistent and high quality distribution of carbonated water in absolutely sanitary conditions.

The prior art is clearly shown in FIG. 6 wherein weld protrusions 78 can be seen obstructing flow of carbonated water. It is these obstructions that cause decarbonation and foaming at one or more of the dispensing heads 36. Also shown are weld voilds 80 that cause sanitation problems. These protrusions 78 and voids 80 are completely unpredictable and cannot be visually ascertained of the fabrication and they have caused significant problems in the past.

FIG. 7 illustrates a further useful alternative embodiment of a dispenser wherein a dispensing tower generally indicated by numeral 100 has a frame 102 which supports a plurality of dispensing heads 36 and a manifold pack 104 for connecting beverage supply lines (not shown) to the heads 36. The manifold pack 104 has a carbonated water distribution manifold 20T embedded within a block of thermal insulation 106. This particular manifold 20T has a pair of inlet fittings, 30T. A remote refrigeration and carbonated water supply device (not shown) has a circulating pump and motor which continualy circulates cold carbonated water through the plenum 32T by pumping one inlet 30T and extracting out of the second inlet 30T or vice versa. The insulation 106 is molded insitu around and to the plenum 32T and at least portions of the inlet and outlet fittings, and the welds of the manifold 20T are no longer accessible for examination or repair.

FIGS. 8 & 9 illustrate an alternative manifold 20CP being utilized at a cast aluminum cold plate generally indicated by the numeral 110, and which when used will have ice cubes loaded on its upper surface 112 for cooling carbonated water and/or syrup in the cold plate liquid circuits to be described.

The manifold 20CP has its plenum 32CP preferably located just under and parallel to the top surface 112 and adjacent to periphery edge 114 of the cold plate 110. The water outlet fittings 34CP extend upward for connection to lines leading to dispensing heads 36 or for connection directly to dispensing heads 36. The plenum is supplied by at least one and possibly two inlet fittings 30CP which is this case are also the water cooling coils in the cold plate 110. The inlet fitting coils 30CP will preferably be wound into involute spirals as seen in FIG. 9 and will be fed warm water at the center and then the outer most coil will be conencted directly to the plenum 32CP to feed cold carbonated water into the plenum. If there are two coils 30CP, they will be one above the other and they will connect into the ends of the plenum 32CP as shown; they may also be counter flow wherein the upper one feeds clockwise and the lower one feeds counter-clockwise or vice versa. If there are two inlet fitting coils 30CP, they will be fluidly connected in parallel to a supply of carbonated water. Syrup cooling coils 116 are embedded underneath and spaced from the water inlet fitting coils 30CP.

The use of the improved manifold 20, 20T, 20CP in dispenser 10, tower 100 or cold plate 110 enables the addition of considerable value to these structures, upon based reliability of the manifold 20, 20T, 20CP with complete confidence that the finished high value product will not be defective or scrap, and that it will work properly and dispense cold carbonated beverage without pressure and flow drop, decarbonation, or foaming. The manufacturing process becomes much more effective because there is negligible scrap and vastly increased quality at a lesser cost.

Although other advantages may be found and realized, and various and minor modifications suggested by those versed n the art, be it understood that I wish to embody within the scope of the patent warranted hereon, all such embodiments as reasonably and properly come within the scope of my contribution to the art.

I claim as my invention:

1. In a cold carbonated beverage dispenser having:

a carbonator with a carbonated water outlet and at least one inlet having means for being connected to sources of water and carbon dioxide, a plurality of post-mix carbonated beverage dispensing heads, each head having a syrup inlet for being connected to a respective discrete source of beverage syrup and a carbonated water inlet for being fluidly connected to the carbonator, the improvement of:

a carbonated water distribution manifold fluidly connecting the carbonator water outlet to the carbonated water inlet of each dispensing head, said manifold comprising:

(1) a discrete tubular stainless steel outlet fitting for each dispensing head, each outlet fitting having a water outlet passageway therethrough and an outlet end fluidly connected to a respective dispensing head carbonated water inlet, (2) a carbonated water distribution plenum fluidly in between said outlet fittings and the carbonator, (3) a carbonated water inlet fitting having an inlet water passageway therethrough and its inlet end fluidly connected to the carbonator water outlet and its outlet end fluidly connected into the plenum;

(4) a generally planar stainless steel sheet metal outlet wall forming at least part of said plenum with an inlet end of each outlet fitting extending through the outlet wall and into the plenum and being welded from the inside of the plenum to an inner surface of the outlet wall, and (5) a convex smoothly curved toroidal inlet nose surrounding the inlet end of each outlet fitting, each said inlet nose being in said plenum and having a minor diameter which is substantially the same as and which is co-axial with a inlet diameter of the outlet fitting water outlet passageway.

2. The dispenser of claim 1, including a generally planar stainless steel sheet metal inlet wall forming at least part of said plenum, said inlet fitting having an inlet end extending through the inlet wall and into the plenum and which is welded from the inside of the plenum to an inner surface of the inlet wall, and a convex smoothly curved toroidal outlet nose surrounding the outlet end of the inlet fitting, said outlet nose being in said plenum and having a minor diameter substantially the same as and which is co-axial with an outlet diameter of the outlet fitting water passageway.

3. The dispenser of claim 1, in which the plenum has a larger internal cross section and a heavier wall section than either the inlet fitting or any of outlet fittings.

4. The dispenser of claim 1, in which each outlet fitting is adjoined to an annular flange materially integral with and extending from a respective plenum wall into the inside of the plenum, said flange forming an outer majority of each said toroidal inlet nose.

5. The dispenser of claim 1, in which the plenum is embedded within a thermal insulation block molded insitu around the plenum and outlet fittings.

6. The dispenser of claim 1, in which the plenum and at least a portion of each inlet fitting are embedded in a cast aluminum cold plate.

7. The dispenser of claim 1, including an ice water tank for cooling of the water, said plenum being in said tank below a nominal tank water level, said outlet fittings extending upward from the plenum to above the tank water level to where said outlet fittings are fluidly connected to the respective dispensing heads, said inlet fitting also extending upward of the plenum and to above the tank water level.

8. The dispenser of claim 7, in which the plenum extends across the complete width of the tank.

9. The dispenser of claim 7, in which said plenum has a constant cross section, with an exterior surface of the plenum resting upon a bottom of the tank.

10. The dispenser of claim 9, in which the outlet wall faces upward and is generally parallel to the water level.

11. The dispenser of claim 9, in which the inlet wall is generally perpendicular to the tank bottom, and in which the inlet fitting extends generally horizontal across the tank over the bottom and then upwardly along an upright side wall of the tank.

* * * * *